United States Patent [19]

Wolnowsky et al.

[11] 4,044,204

[45] Aug. 23, 1977

[54] DEVICE FOR SEPARATING THE VOICED AND UNVOICED PORTIONS OF SPEECH

[75] Inventors: Howard E. Wolnowsky, Mountain View; Erling N. Belland, San Mateo, both of Calif.

[73] Assignee: Lockheed Missiles & Space Company, Inc., Sunnyvale, Calif.

[21] Appl. No.: 654,089

[22] Filed: Feb. 2, 1976

[51] Int. Cl.[2] ..... G10L 1/00

[52] U.S. Cl. ..... 179/1 SA; 179/1 P

[58] Field of Search ..... 179/1 SA, 1 SC, 1 P, 179/1 D

[56] References Cited

U.S. PATENT DOCUMENTS

| | | | |
|---|---|---|---|
| 3,459,894 | 8/1969 | Hoyler | 179/1 D |
| 3,803,357 | 4/1974 | Sacks | 179/1 D |
| 3,903,366 | 9/1975 | Coulter | 179/1 SA |

OTHER PUBLICATIONS

Bakis, R., "Formant Tracking", IBM Tech. Disclosure Bull., June 1962.

*Primary Examiner*—Kathleen H. Claffy
*Assistant Examiner*—E. S. Kemeny
*Attorney, Agent, or Firm*—H. Donald Volk; Billy G. Corber

[57] ABSTRACT

A speech signal-in-noise enhancement system which separates the voiced-unvoiced portions of speech, detects and extracts the voiced fundamental pitch and uses that data to control the band-pass center frequencies of a bank of filters so that the filters pass the harmonics of the fundamental pitch. The output of these filters is summed to form a composite signal representative of voiced speech. Unvoiced speech is separately passed to the summer.

3 Claims, 4 Drawing Figures

DEVICE FOR SEPARATING THE VOICED AND UNVOICED PORTIONS OF SPEECH

BACKGROUND OF THE INVENTION

Human speech can be considered to be made up of two major components: voiced sounds, generally known as vowels, wherein the vocal cords are active, and unvoiced sounds, where the sound is generated by a constriction or manipulation of the breath channel. Voiced sounds have a quasi-periodic spectral structure of relatively long time duration while the unvoiced sounds are often shorter in duration, broad band and noise-like in their spectral distribution. Most of the speech energy is contained in the voiced portion of the speech signal. In speech processing activities it is often desirable to extract the voiced signal portion of a single talker from a composite of the entire speech signal or from a high noise environment. The circuitry needed to accomplish this task includes a bank of band-pass filters coinciding with the harmonics of the instantaneous voice pitch. There is a significant variation in the instantaneous voice pitch in the speech of a single talker and a very large variability in pitch between different talkers. Consequently, a fixed frequency set of band-pass filters cannot meet the requirements. A filter set capable of being steered to the correct frequencies on a dynamic basis is needed, along with a control signal which represents the pitch of the voice signal to be processed.

The present system basically measures the voice fundamental frequency and uses this information to electrically control a number of narrow-band tracking filters which pass the narrow bands of frequencies that contain the voice pitch harmonics. The outputs of these individual filters are then summed to give the voiced speech portion of one talker's voice signal.

SUMMARY OF THE INVENTION

The preferred embodiment of the invention shows a system for extracting the voiced portion of a voice signal. The input, after being amplified, is fed to a pitch extractor. The output from the pitch extractor is used to control the center frequencies of a set of band-pass filters. The original amplified input signal is also fed through a delay circuit to each of the controlled band-pass filters. The band-pass filter set spans the frequency range from the voice pitch to a fixed multiple of the voice fundamental frequency.

For some applications it is desirable to include the unvoiced speech signal along with the summed output of the filter bank. Since the voiced and unvoiced speech signals do not generally coincide in time, an output from the pitch extractor indicating absence of a voiced speech signal can be used to control a shunt signal channel to include a filtered version of the input signal in the summed output signal.

BRIEF DESCRIPTION OF THE DRAWINGS

Other objects and advantages of this invention will be readily appreciated and the same can be better understood by reference to the following detailed description when considered in connection with the accompanying drawings, wherein.

DESCRIPTION OF THE PREFERRED EMBODIMENT

Figure 1:
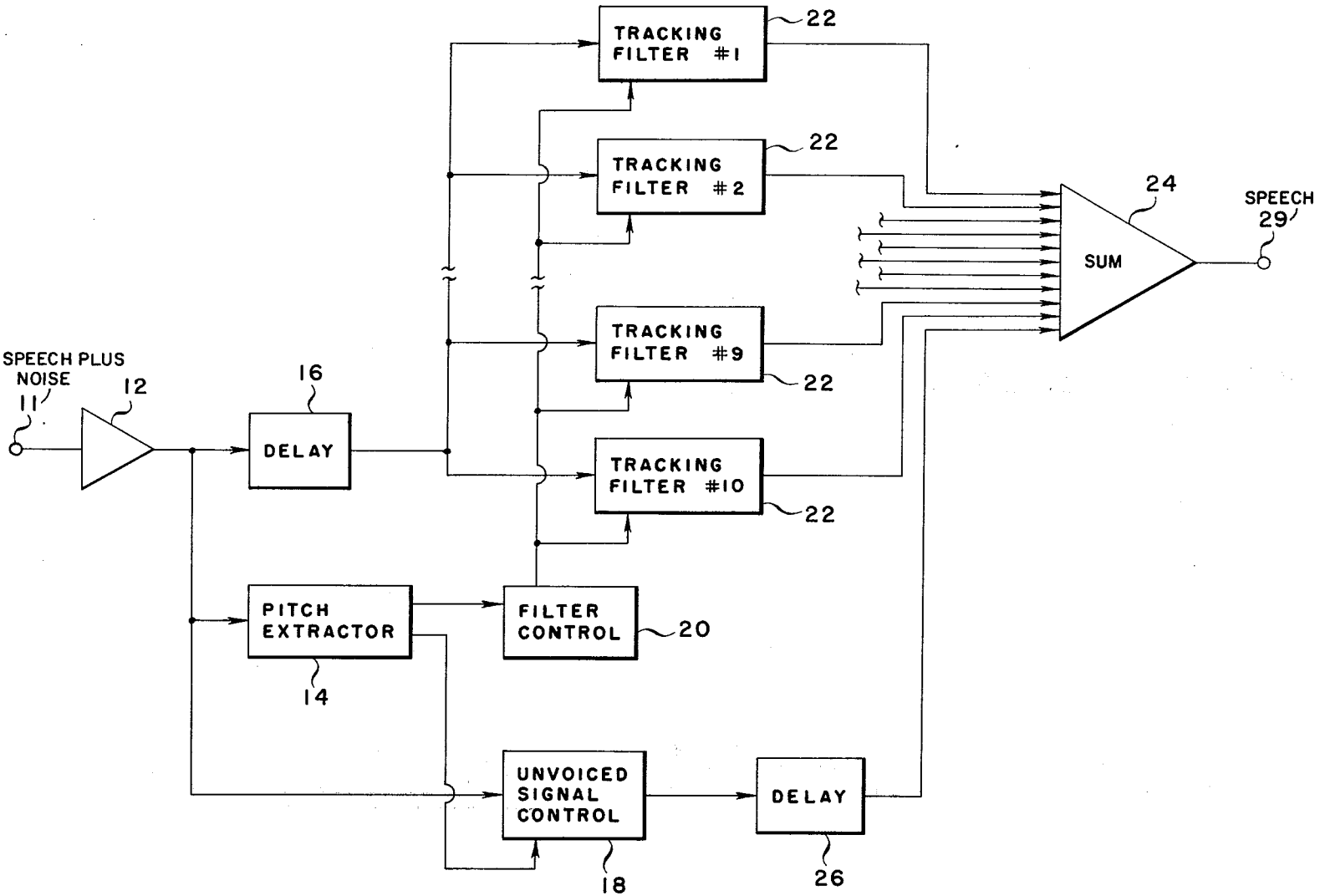
FIG. 1 is a block diagram of the enhancement system of the present invention.

Referring to the FIG. 1, sound waves entering the system by way of input terminal 11 are amplified to a suitable level for processing by input amplifier 12. Delay circuit 16, pitch extractor 14 and unvoiced signal control circuit 18 are connected to the output of the input amplifier 12. Pitch extractor 14 detects the pitch frequency of the input signal and provides a digital word output that is proportional to the measured pitch frequency.

Such a pitch extractor is shown in co-pending application Ser. No. 619,895 to Wolnowsky, Belland and Lee and is assigned to same assignee as the present application.

This co-pending application shows a method of determining in real-time the pitch of acoustic signals and, in particular, that of the human voice. A bank of contiguous band-pass filters spans the expected frequency range of the fundamental pitch and the lower harmonic pitch frequencies. These band-pass filters separate a portion of the incoming voice signal energy into individual harmonics of the pitch frequency. The band-pass filter outputs each control a digital pulse generator in which the phase can be instantaneously set to zero electrical degrees. The digital circuits generate pulses whose power is controlled to be proportional to the sound power in the associated band-pass filter, and whose rate follows the band-pass filter signal rate. These pulses are summed to form a composite wave form. This signal will have maximum amplitude at a time period corresponding to the fundamental frequency of the sound signal. This maximum pulse amplitude is detected and the pitch signal output derived therefrom at the same rate as the original speech signal is delivered. Additive noise degradation of the original sound signal is effectively discriminated against. Most of the circuitry subsequent to the band-pass filters is digital in order to achieve the requisite stability and accuracy.

Figure 2:
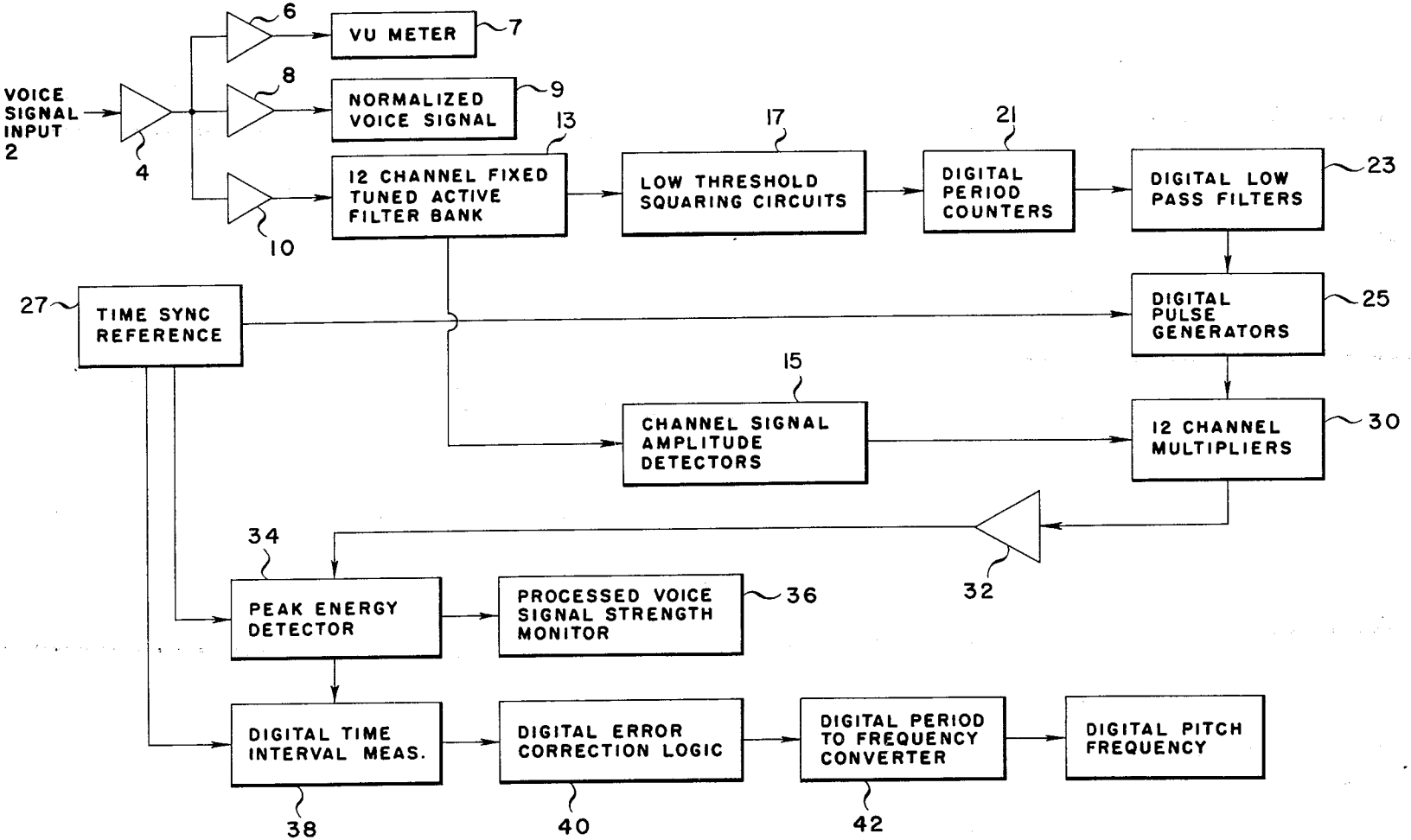
FIG. 2 is a block diagram of the pitch extractor 14.

Specifically, FIG. 2 is a block diagram of the pitch extractor of this co-pending U.S. Patent Application Ser. No. 619,895. Referring to FIG. 2, sound waves entering the system by way of input line 2 are amplified to a suitable level for processing by input amplifier 4. Isolation amplifiers 6, 8 and 10 are connected to the output of the input amplifier 4. A conventional monitor, such as meter 7, can be connected to the output of isolation amplifier 6 and is provided to aid in adjusting the gain of input amplifier 4. An audio monitor 9 can be connected to the output of isolation amplifier 8 to provide an audio indication of the input signal.

An active filter bank 13 is connected to the output of isolation amplifier 10. The active filter bank 13 comprises 12 contiguous band-pass filters that together span from 105 Hertz to 885 Hertz, a range wherein most voiced energy will be found. Each band-pass filter has a 65 Hertz, 3db band-width. The function of the active filter bank 13 is to separate the fundamental frequency and its first few harmonics, below about 900 Hertz. The output of each of the band-pass filters in active filter bank 13 is connected to an individual channel amplitude detector 15 and a low amplitude threshold comparator circuit 17.

Each channel amplitude detector 15 consists of a full-wave rectifier followed by a single pole pair 50 Hertz low pass filter. The purpose of the amplitude detector is to utilize the difference in amplitude between the harmonics of the fundamental pitch and the broader spectrum of noise or unvoiced signals in a subsequent signal processing circuit, the multiplier 30.

Each low threshold comparator circuit 17 generates a fixed amplitude square wave of the same frequency as the filter output. The purpose of the threshold comparator circuit is to provide. logic level transitions at signal zero crossings such that the time interval between the logic level transitions may be used to measure the time between successive zero crossings of the filter output and hence derives the frequency of the dominant signal appearing in each filter output.

The output of each threshold comparator circuit 17 is connected to the input of a digital period counter 21. Each digital period counter 21 measures the period of its input square wave and provides a digital word output which is inversely proportional to its associated band-pass filter frequency.

A digital low pass filter 23 is connected to the output of each digital period counter 21. These filters have a frequency cutoff of approximately 10 Hertz. Since voiced sounds rarely exhibit pitch dynamic changes of 5 Hertz or more during normal speech, the low pass filters 23 effectively block any higher rate changes in the signal which are generated by noise or unvoiced sounds.

Figure 3:
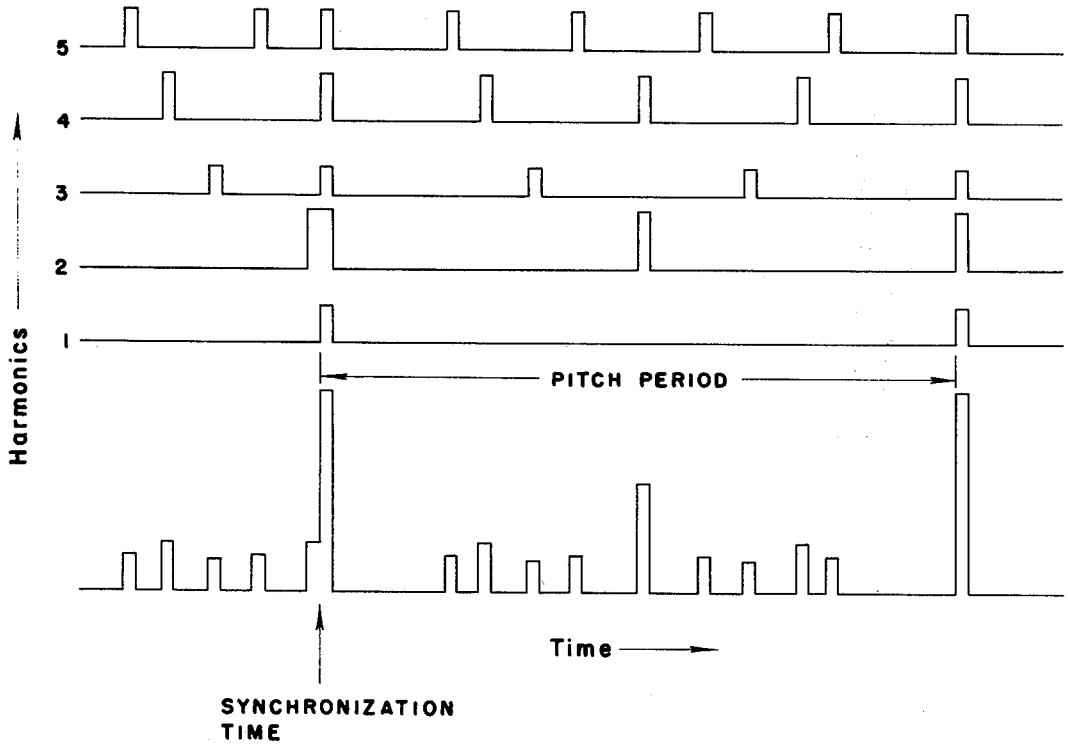
FIG. 3 is a representation of the harmonic pulse summing to form the histogram.

The output from each digital low pass filter is connected to a separate digital pulse generator 25. The digital pulse generators 25 generate pulse trains having repetition frequencies equal to 16 times the reciprocal of the input periods (i.e., 16 times the input frequency) from the low pass filters 24. The amplitude and duration of the ouput pulses generated by all the generators 25 are all equal. A time synchronization reference 27 is also connected to each digital pulse generator 25. The purpose of the time synchronization reference 27 is to synchronize the start time of the outputs of all the digital pulse generators 25 so that if the output period of two or more generators are integer multiples of each other, the output pulses from these generators will coincide at the times of the lower frequency pulses. See FIG. 3.

The outputs from the 12 digital pulse generators 25 are each connected to one channel of a 12-channel multiplier 30. Similarly, the corresponding 12 outputs from the channel amplitude detectors 13 are also connected to the 12-channel multiplier. The function of the multiplier 30 is to amplitude weigh the output from each of the digital pulse generators 25 with the corresponding output from the amplitude detector to produce an output pulse train having a frequency proportional to the output from the digital pulse generator 25 and an amplitude proportional to the output from the amplitude detector 15.

A summation amplifier 32 is connected to the 12-channel outputs from the multiplier 30. The function of the summation amplifier 32 is to add the pulses from the multiplier 30 to form a time synchronized composite pulse train. The composite train will contain pulses of higher magnitude where harmonic signals are present since the time coincident pulses will add together.

Figure 4:
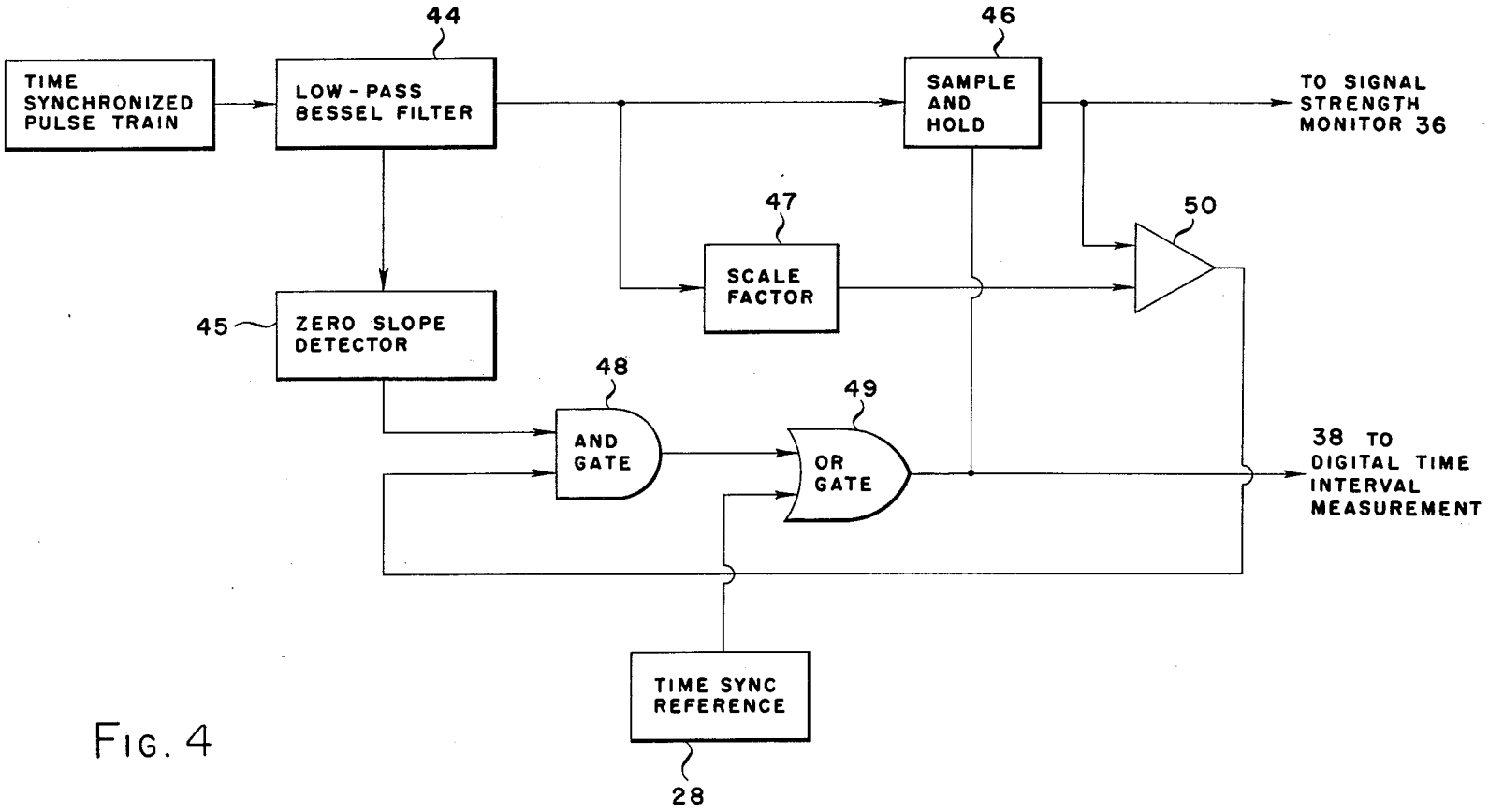
FIG. 4 is a schematic block diagram of the peak energy detector 34.

A peak energy detector 34 is connected to the output from the summation amplifier 32. The peak energy detector, which is shown in FIG. 4 and explained in detail below, comprises a system of filters and sample-and-hold circuits. The peak energy detector 34 produces pulse outputs coincident in time with the peak energy of the composite wave train. One output from the peak energy detector 34 provides an output voltage proportional to the peak energy of the composite wave train. This output is connected to a signal strength monitor 36. The function of the signal strength monitor 36 is to measure the magnitude of harmonic energy contained in the input signal. The second output from the peak energy detector 34 is connected to a digital time interval measurement system 38.

An output from the time synchronization reference 27 is also connected to the digital time interval measurement system 38. The digital time interval measurement system 38 measures the time difference between the largest peak pulse and the time synchronization reference.

Digital error correction logic means 40 is connected to the output from the digital time interval measurement system 38. This correction logic means 40 compares successive output values from the measurement system 38 and suppresses large magnitude changes greater than those occurring naturally within voiced speech.

Digital period to frequency converter 42 is connected to the output from the digital error correction logic means 40 and provides a digital word that is proportional to the measured pitch frequency through the use of digital divider circuitry.

FIG. 4 shows the details of the peak energy detector 34. The composite positive pulse train from summation amplifier 32 is fed to a low pass Bessel filter 44 of conventional active filter design. The filtered output is applied to the input of a sample-and-hold-circuit 46 and is multiplied by a constant of about 0.9 in circuit 47. If the scaled output from circuit 47 is larger than the amplitude value stored in 46, the comparator output changes state, commanding via gates 48 and 49 sample-and-hold 46 to store the new amplitude value. The time of occurrence of the pulse peak of the new pulse is needed. The zero slope detector 45 gates the comparator 50 output at the peak pulse time through to the sample-and-hold 46 control input and to the time interval measurement circuit 38. The sample-and-hold 46 is reset at the end of the observation period by the time synchronization reference 27 signal via "OR" gate 49.

As indicated above, the digital period to frequency converter 42 provides, as an output, a digital word that is proportional to the measured pitch frequency. Filter control 20 (FIG. 1) is connected to this output. Filter control 20 is connected to the output of pitch extractor 14.

Again referring to FIG. 1, the input signal, after being delayed by delay circuit 16, is fed to a plurality of tracking filters 22. Although 10 tracking filters 22 are indicated in the drawing, it should be understood that the number of filters that may be used would be dictated by the particular application. The output from filter control 20 is connected to each of the tracking filters 22 to control the tuning of the tracking filters 22. A digitally controlled active filter and a control circuit for said filters usable in the present invention is shown and described in co-pending patent application Ser. No. 636,106 by Harris and Lee and assigned to same assignee as the present application. The digitally controlled active filter and the control circuit is also discussed in "Digitally Controlled, Conductance Tunable Active Filters," by Harris and Lee, IEEE Journal of Solid-State Circuits, June 1975, pages 182–184.

The outputs from tracking filters 22 are fed into conventional summing amplifier 24.

The unvoiced signal control circuit 18, as noted above, is connected to the output of input amplifier 12. The unvoiced signal control circuit 18 is controlled by an output from pitch extractor 14 so that it is shut off during portions of voiced speech and is turned on at all other times to pass the unvoiced signal to delay circuit 26. Delay circuit 26 delays the output from unvoiced signals control 118 to make its output have the correct time relationship to the output signals from tracking filters 22. The output from delay 26 is fed to summing amplifier 24 along with the output from tracking filters 22 to produce an output at terminal 28.

Other modifications and advantageous applications of this invention will be apparent to those having ordinary skill in the art. Therefore, it is intended that the matter contained in the foregoing description and the accompanying drawings is interpreted as illustrative and not limitative, the scope of the invention being defined by the appended claims.

What is claimed is:

1. A device for separating the voiced portion of speech from voice communications comprising:

input amplifier means for amplifying the input electrical signal representative of sound, a plurality of tracking filters operably connected to the output of said input amplifier means, means for extracting the fundamental pitch frequency of the voiced portion of the input signal, said extraction means connected to the output of said amplifier means, said pitch extracting means further defined as providing an output proportional to the fundamental pitch frequency, said output being operably connected to said plurality of tracking filters for controlling the tuning of said filters, a summing amplifier, the outputs of said plurality of tracking filters connected to the input of said summing amplifier.

2. The system of claim 1 including unvoiced signal control means connected to the output of said input amplifier, said pitch extracting means also connected to said unvoiced signal control means for maintaining said unvoiced signal control means in an "off" condition when voiced signal is detected by said pitch extracting means, and in an "on" condition when no voiced signal is detected by said pitch extracting means.

3. The system of claim 2 wherein said unvoiced signal control means includes an output and wherein said output is operably connected to the input of said summing amplifier.

* * * * *